US005376310A

United States Patent [19]

Cripe et al.

[11] Patent Number: 5,376,310

[45] Date of Patent: Dec. 27, 1994

[54] ALKALINE LIGHT DUTY DISHWASHING DETERGENT COMPOSITION CONTAINING AN ALKYL ETHOXY CARBOXYLATE SURFACTANT, MAGNESIUM IONS, CHELATOR AND BUFFER

[75] Inventors: Thomas A. Cripe; Kofi Ofosu-Asante, both of Cincinnati, Ohio

[73] Assignee: The Procter & Gamble Co., Cincinati, Ohio

[21] Appl. No.: 80,733

[22] Filed: Jun. 22, 1993

Related U.S. Application Data

[63] Continuation of Ser. No. 839,738, Feb. 19, 1992, abandoned, which is a continuation of Ser. No. 614,532, Nov. 16, 1990, abandoned.

[51] Int. Cl.[5] ..... C11D 1/06; C11D 3/30; C11D 3/33

[52] U.S. Cl. ..... 252/548; 252/117; 252/156; 252/174.21; 252/174.22; 252/174.19; 252/DIG. 1; 252/DIG. 14

[58] Field of Search ..... 252/108, 117, 156, 174.21, 252/174.22, 174.19, DIG. 1, DIG. 14, 548

[56] References Cited

U.S. PATENT DOCUMENTS

| | | | |
|---|---|---|---|
| 2,183,853 | 12/1939 | Hausmann | 252/174.21 |
| 3,003,954 | 10/1961 | Brown | 252/8.8 |
| 3,038,862 | 6/1962 | de Jong et al. | 252/152 |
| 3,741,911 | 6/1973 | Shane | 252/135 |
| 3,941,710 | 4/1976 | Gilbert | 252/99 |
| 3,992,443 | 11/1976 | Springmann | 260/535 |
| 4,098,818 | 7/1978 | Krummel et al. | 260/535 R |
| 4,133,779 | 1/1979 | Hellyer et al. | 252/547 |
| 4,223,163 | 9/1980 | Guilloty | 252/170 |
| 4,223,460 | 11/1980 | Willis et al. | 562/537 |
| 4,316,824 | 2/1982 | Pancheri | 252/551 |
| 4,435,317 | 3/1984 | Gerritsen | 252/547 |
| 4,441,881 | 4/1984 | Ruppert et al. | 8/137 |
| 4,555,360 | 11/1985 | Bissett et al. | 252/541 |
| 4,615,819 | 10/1986 | Leng et al. | 252/110 |
| 4,625,057 | 11/1986 | Springmann et al. | 562/470 |
| 4,681,704 | 7/1987 | Bernardino et al. | 252/546 |
| 4,692,275 | 9/1987 | Secemski et al. | 252/534 |
| 4,721,579 | 1/1988 | Kim | 252/79 |
| 4,759,875 | 7/1988 | Hart | 252/551 |
| 4,800,037 | 1/1989 | Mazzola | 252/109 |
| 4,818,440 | 4/1989 | Schäfer | 252/DIG. 5 |
| 5,013,485 | 5/1991 | Tsukuda et al. | 252/551 |
| 5,230,823 | 7/1993 | Wise et al. | 252/174.21 |

FOREIGN PATENT DOCUMENTS

| | | |
|---|---|---|
| 912395 | 10/1972 | Canada . |
| 0072600 | 2/1983 | European Pat. Off. . |
| 0154380 | 9/1985 | European Pat. Off. . |
| 2014084 | 4/1970 | France . |
| 48-60706 | 8/1973 | Japan . |
| 48-64102 | 9/1973 | Japan . |
| 49-37908 | 4/1974 | Japan . |
| 55-144099 | 11/1980 | Japan . |
| 57-202391 | 12/1982 | Japan . |
| 61-21199 | 1/1986 | Japan . |
| 682132 | 11/1969 | South Africa . |
| 456517 | 11/1936 | United Kingdom . |
| 1027481 | 4/1966 | United Kingdom . |
| 1284791 | 8/1972 | United Kingdom . |
| 1468856 | 3/1977 | United Kingdom . |
| 1475064 | 6/1977 | United Kingdom . |
| 2197338A | 5/1988 | United Kingdom . |

*Primary Examiner*—Paul Lieberman
*Assistant Examiner*—E. M. Higgins
*Attorney, Agent, or Firm*—Mary P. McMahon; Fernando A. Borrego; Jacobus C. Rasser

[57] ABSTRACT

A light-duty liquid or gel dishwashing detergent composition containing an alkyl ethoxy carboxylate surfactant, magnesium ions, a magnesium chelating agent, and a buffering agent to maintain the pH of the composition from about 8 to 10. High pH and magnesium ions of the composition provide good grease removal properties while maintaining mildness to the skin. The buffering agent and chelating agent of the composition provide superior physical and chemical stability during storage. The preferred type of dishwashing detergent composition is in the liquid form.

20 Claims, No Drawings

ALKALINE LIGHT DUTY DISHWASHING DETERGENT COMPOSITION CONTAINING AN ALKYL ETHOXY CARBOXYLATE SURFACTANT, MAGNESIUM IONS, CHELATOR AND BUFFER

This is a continuation of application Ser. No. 07/839,738, filed on Feb. 19, 1992, now abandoned, which is a continuation of application Ser. No. 07/614,532 filed on Nov. 16, 1990, now abandoned.

TECHNICAL FIELD

The present invention relates to light-duty liquid or gel dishwashing detergent compositions containing alkyl ethoxy carboxylate surfactants (alternatively labeled alkyl polyethoxy carboxy methylates, alkyl polyethoxy acetates, alkyl polyether carboxylates, etc.) of the type disclosed in U.S. Pat. Nos. 2,183,853; 2,653,972; 3,003,954; 3,038,862; 3,741,911; and 3,941,710; British Pat. Nos. 456,517 and 1,169,496; Canadian Pat. No. 912,395; French Pat. Nos. 2,014,084 and 2,042,793; Netherland Patent Application Nos. 7,201,735-Q and 7,406,336; and Japanese Patent Application Nos. 96,579/71 and 99,331/71.

BACKGROUND ART

There has been considerable demand for light-duty liquid or gel dishwashing detergents capable of providing good grease removal. These compositions are well known in the art and are described, for example, in U.S. Pat. Nos. 4,316,824 (Pancheri), 4,681,704 (Bernardino et al.), 4,133,779 (Hellyer et al.), and 4,615,819 (Leng et al.). These compositions, although being good grease and soil cleaners, can be harsh to the skin under certain conditions, particularly when used during the dry winter months.

Likewise, the art is replete with detergent compositions that are mild to the skin. These mild compositions often contain sulfates of highly ethoxylated alcohols. See, for example, U.S. Pat. No. 3,743,233, Rose and Thiele. Betaines have also been suggested for use in improving mildness of a liquid dishwashing composition. See, for example, U.S. Pat. No. 4,555,360 (Bissett et al.). Alkyl ethoxy carboxylates are also known as mild surfactants for use in liquid detergent compositions. See Japanese Patent Applications 48-60706 and 48-64102. These alkyl ethoxy carboxylate surfactants, however, have been described as being poor in their grease cutting ability and require the use of other surfactants to achieve the desired cleaning.

Rarely have these two important features of mildness and grease cutting ability been incorporated into one product. It is generally thought that one must be sacrificed for the benefit of the other. It has been discovered that detergent compositions containing a particular alkyl ethoxy carboxylate surfactant mixture provide good grease removal while manifesting mildness to the skin. This dual benefit is enhanced when the composition contains magnesium ions and are at an alkaline pH.

These alkaline compositions containing magnesium ions may exhibit poor stability during storage though. In an alkaline environment, the precipitation of magnesium hydroxide can be a substantial problem. Therefore, it is an object of this invention to provide a detergent composition that exhibits good grease removal and mildness to the skin, while providing superior stability during storage of the composition.

SUMMARY OF THE INVENTION

The present invention relates to a light-duty liquid or gel, preferably liquid, dishwashing detergent composition comprising:

(a) from about 5% to 70% of a surfactant mixture comprising:

(i) from about 70% to 100% of alkyl ethoxy carboxylates of the formula:

$$RO(CH_2CH_2O)_xCH_2COO^-M^+$$

wherein R is a $C_{12}$ to $C_{16}$ alkyl group, x ranges from 0 to about 10 and the ethoxylate distribution is such that, on a weight basis, the amount of material where x is 0 is less than about 20% and the amount of material where x is greater than 7 is less than about 25%, the average x is from about 2 to 4 when the average R is $C_{13}$ or less, and the average x is from about 3 to 6 when the average R is greater than $C_{13}$, and M is a cation;

(ii) from 0% to about 15% of alcohol ethoxylates of the formula:

$$RO(CH_2CH_2O)_xH$$

wherein R is a $C_{12}$ to $C_{16}$ alkyl group and x ranges from 0 to about 10 and the average x is less than about 6; and (iii) from 0% to about 15% of soaps of the formula:

$$RCOO^-M^+$$

wherein R is a $C_{11}$ to $C_{15}$ alkyl group and M is a cation;

(b) from about 0.1% to about 3% of magnesium ions;

(c) a magnesium chelating agent which forms a soluble magnesium complex, having a formation constant, log $K_f$, between about 0.5 and 5, in an amount sufficient to prevent the formation of $Mg(OH)_2$ precipitates in the composition; and (d) sufficient alkalinity buffering agent to maintain the pH of the composition between about 8 and 10 when diluted with water to about 0.1% to 0.4%, by weight.

DETAILED DESCRIPTION OF THE INVENTION

The light-duty liquid or gel, preferably liquid, dishwashing detergent compositions of the present invention contain an alkyl ethoxy carboxylate surfactant mixture, a source of magnesium ions, a magnesium chelating agent, and an alkalinity buffering agent. These and other complementary optional ingredients typically found in liquid or gel dishwashing compositions are set forth below.

Alkyl Ethoxy Carboxylate-Containing Surfactant Mixture

The liquid compositions of this invention contain from about 5% to 50% by weight, preferably from about 8% to 40%, most preferably from about 10% to 30%, of a surfactant mixture restricted in the levels of contaminants. Gel compositions of this invention contain from about 5% to about 70%, preferably from about 10% to about 45%, most preferably from about 12% to about 35%, of the surfactant mixture.

The surfactant mixture contains from about 70% to 100%, preferably from about 80% to 95%, most preferably from about 90% to 95%, of alkyl ethoxy carboxylates of the generic formula $RO(CH_2CH_2O)_xCH_2COO^-M^+$ wherein R is a $C_{12}$ to $C_{16}$ alkyl group, x ranges from 0 to about 10, and the ethoxylate distribution is such that, on a weight basis, the amount of material where x is 0 is lo less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, alkaline earth metal, most preferably from sodium, potassium, and mixtures thereof with magnesium ions. The preferred alkyl ethoxy carboxylates are those where R is a $C_{12}$ to $C_{14}$ alkyl group.

Suitable alcohol precursors of the alkyl ethoxy carboxylates of this invention are primary aliphatic alcohols containing from about 12 to about 16 carbon atoms. Other suitable primary aliphatic alcohols are the linear primary alcohols obtained from the hydrogenation of vegetable or animal fatty acids such as coconut, palm kernel, and tallow fatty acids or by ethylene build up reactions and subsequent hydrolysis as in the Ziegler type processes. Preferred alcohols are n-octyl, n-nonyl, n-decyl, n-undecyl, n-dodecyl, n-tridecyl, n-tetradecyl, n-pentadecyl, and n-hexadecyl. Other suitable alcohol precursors include primary alcohols having a proportion of branching on the beta or 2-carbon atoms wherein the alkyl branch contains from 1 to 4 carbon atoms. In such alcohols at least 30% of the alcohol of each specific chain length is desirably linear and the branching preferably comprises about 50% of methyl groups with smaller amounts of ethyl, propyl and butyl groups. These alcohols are conveniently produced by reaction of linear olefins having from about 11 to 17 carbon atoms with carbon monoxide and hydrogen. Both linear and branched chain alcohols are formed by these processes and the mixtures can either be used as such or can be separated into individual components and then recombined to give the desired blend.

Typical processes for producing "Oxo" halides which are then used to prepare alcohols are disclosed in U.S. Pat. Nos. 2,564,456 and 2,587,858 and the direct hydroformylation of olefins to give alcohols is disclosed in U.S. Pat. Nos. 2,504,682 and 1,581,988. All of these patents are incorporated herein by reference.

The equivalent secondary alcohols can also be used. It will be apparent that by using a single chain length olefin as starting material, a corresponding single chain length alcohol will result, but it is generally more economical to utilize mixtures of olefins having a spread of carbon chain length around the desired mean. This will, of course, provide a mixture of alcohols having the same distribution of chain lengths around the mean.

Primary aliphatic alcohols derived from vegetable oils and fats and from other petroleum feed stocks having alkyl or alkylene groups as part of their structure will also contain a range of chain lengths. Since the range of chain lengths is $C_8$–$C_{20}$ and beyond, it is therefore normal practice to separate the product from such feed stocks into different chain length ranges which are chosen with reference to their ultimate use.

The desired average ethoxy chain length on the alcohol ethoxylate can be obtained by using a catalyzed ethoxylation process, wherein the molar amount of ethylene oxide reacted with each equivalent of fatty alcohol will correspond to the average number of ethoxy groups on the alcohol ethoxylated. The addition of ethylene oxide to alkanols is known to be promoted by a catalyst, most conventionally a catalyst of either strongly acidic or strongly basic character. Suitable basic catalysts are the basic salts of the alkali metals of Group I of the Periodic Table, e.g., sodium, potassium, rubidium, and cesium, and the basic salts of certain of the alkaline earth metals of Group II of the Periodic Table, e.g., calcium, strontium, barium, and in some cases magnesium. Suitable acidic catalysts include, broadly, the Lewis acid of Friedel-Crafts catalysts. Specific examples of these catalysts are the fluorides, chlorides, and bromides of boron, antimony, tungsten, iron, nickel, zinc, tin, aluminum, titanium, and molybdenum. The use of complexes of such halides with, for example, alcohols, ethers, carboxylic acids, and amines have also been reported. Still other examples of known acidic alkoxylation catalysts are sulfuric and phosphoric acids; perchloric acid and the perchlorates of magnesium, calcium, manganese, nickel, and zinc; metals oxalates, sulfates, phosphates, carboxylates, and acetates; alkali metal fluoroborates, zinc titanate; and metal salts of benzene sulfonic acid. The type of catalyst used will determine the distribution of the range of ethoxy groups. Stronger catalysts will result in a very tight or narrow distribution of the ethoxy groups around the mean. Weaker catalysts will result in a wider distribution.

The surfactant mixture also contains from 0% to about 15%, preferably less than about 10%, most preferably less than about 5%, of alcohol ethoxylates of the formula $RO(CH_2CH_2O)_xH$ wherein R is a $C_{12}$ to $C_{16}$ alkyl group and x ranges from 0 to about 10 and the average x is less than 6. The surfactant mixture also contains 0% to about 15%, preferably less than about 10%, most preferably less than about 5%, of soaps of the formula $RCOO^-M^+$ wherein R is a $C_{11}$ to $C_{15}$ alkyl group and M is a cation as described above.

The uncarboxylated alcohol ethoxylates noted above are a detriment to the alkyl ethoxy carboxylate surfactant mixture, especially with respect to the performance benefits provided therefrom. Therefore, it is critical that the alkyl ethoxy carboxylate-containing surfactant mixture used in this invention contain less than about 15% by weight of the alcohol ethoxylates they are derived from. Although commercially available alkyl ethoxy carboxylates contain 10% or more of alcohol ethoxylates, there are known routes to obtain the desired high purity alkyl ethoxy carboxylates. For example, unreacted alcohol ethoxylates can be removed by steam distillation, U.S. Pat. No. 4,098,818 (Example I), or by recrystallization of the alkyl ethoxy carboxylate, British Pat. No. 1,027,481 (Example 1). Other routes to the desired carboxylates are the reaction of sodium hydroxide or sodium metal and monochloracetic acetic, or its salt, with alcohol ethoxylates under special pressure and temperature combinations, as described in U.S. Pat. Nos. 3,992,443 and 4,098,818; and Japanese Patent Application No. 50-24215, all incorporated herein by reference.

Alternatively, a hindered base, such as potassium tert-butoxide can replace the sodium hydroxide in the above cited patents, thus yielding high purity alkyl ethoxy carboxylates with less stringent temperature and pressure requirements. Specifically, a hindered base of the formula $RO^-M^+$, constituting generally an alkyl group, a reactive oxygen center, and a cation is used. The structure of this hindered base is secondary or tertiary and contains a non-linear alkyl group with at least one site of branching within 3 carbon atoms of the reactive center, the oxygen atom, and an alkali metal or alkaline earth metal cation. The process comprises reacting the alcohol ethoxylates with the hindered base described above and either anhydrous chloroacetic acid, at a molar ratio of the hindered base to the anhydrous chloroacetic acid of 2:1, or an alkali metal salt or alkaline earth metal salt of anhydrous chloroacetic acid, at a molar ratio of the hindered base to the alkali metal salt or alkaline earth metal salt of chloroacetic acid of 1:1, wherein the molar ratio of the ethoxylated fatty alcohol to the anhydrous chloroacetic acid or the alkali metal salt or alkaline earth metal salt thereof is from about 1:0.7 to about 1:1.25, the temperature is from about 20° to 140° C., and the pressure is from about 1 to 760 mm Hg.

Other routes to high purity alkyl ethoxy carboxylates are the reaction of alcohol ethoxylate with oxygen in the presence of platinum, palladium, or other noble metals, as disclosed in U.S. Pat. No. 4,223,460 (Example 1–7); U.S. Pat. No. 4,214,101 (Example 1); U.S. Pat. No. 4,348,509; German Patent No. 3,446,561; and Japanese Patent Application No. 62,198,641. One of the by-products of such reactions is soap, which should be limited, as described above, to avoid adversely affecting the cleaning and mildness advantages provided by the present compositions. This can be accomplished by using alcohol ethoxylate feedstock containing low levels of unethoxylated fatty alcohol and by selecting catalysts that preferentially oxidize the terminal methylene in the alcohol ethoxylate, at least about 90% of the time, preferably at least about 95% of the time. Oxidation of non-terminal methylene groups in the alcohol ethoxylate will generate soap from ethoxylated fatty alcohol components.

The cations for the alkyl ethoxy carboxylates herein can be alkali metals and alkaline earth metals. The source of cations for the alkyl ethoxy carboxylates come from neutralization of the alkyl ethoxy carboxylic acid and from additional ingredients, e.g., performance enhancing divalent ion-containing salts.

For the cations coming from the neutralization reaction the preferred cations for compositions of the invention are sodium and potassium. For liquid compositions of the invention, potassium is preferred over sodium since it makes the compositions of the invention more resistant to precipitate formation at low temperatures and provides improved solubility to the composition. On the other hand, for gel compositions of the invention, sodium is preferred over potassium since it makes it easier to gel a composition. Mixtures of the cations may be present in any of the compositions of the invention.

Alkalinity Buffering Agent

The compositions of this invention, when diluted with water to about 0.1% to 0.4%, by weight, have a pH from about 8 to 10. The preferred detergent compositions have a pH from about 8.5 to 9.5.

Traditionally, liquid dishwashing compositions have a pH of about 7. It has been found for detergent compositions of this invention that a more alkaline pH of about 9 greatly increases the grease cleaning as compared to a product with a pH of 7. This cleaning benefit appears to be unique to compositions containing the present alkyl ethoxy carboxylates. Surprisingly, the compositions of this invention are also more mild to hands at this alkaline pH than at a pH of 7.

Dishwashing compositions of the invention will be subjected to acidic stresses created by food soils when put to use, i.e., diluted and applied to soiled dishes. If a composition with a pH greater than 7 is to be most effective in improving performance, it should contain a buffering agent capable of maintaining the alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa value of the buffering agent should be between about 7 and about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and triethanolamine. Other preferred nitrogen-containing buffering agents are 2-amino-2-ethyl-1,3-propanediol, 2-amino-2-methylpropanol, 2-amino-2-methyl-1,3-propanediol, tris-(hydroxymethyl )aminomethane (a.k.a. tris) and disodium glutamate. N-methyl diethanolamine, 1,3-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable.

The buffering agent is present in the compositions of the invention hereof at a level of from about 0.1% to 15%, preferably from about 1% to 10%, most preferably from about 2% to 8%, by weight.

Magnesium Ions

It has been found for the detergent compositions hereof containing alkyl ethoxy carboxylate surfactants that the presence of magnesium ions greatly improves the cleaning of greasy soils. This is especially true when the compositions are used in softened water that contains few divalent ions. Dishwashing liquid compositions containing alkyl ethoxy carboxylates that do not conform to the definition of this invention will be less benefited by the addition of magnesium ions and, in many cases, will actually exhibit reduced cleaning performance upon the addition of divalent cations. It is believed that magnesium ions increase the packing of the present alkyl ethoxy carboxylates at the oil/water interface, thereby reducing interfacial tension and improving grease cleaning.

Preferably, the magnesium ions are added as a chloride, acetate, nitrate, or sulfate salt to compositions containing an alkali metal salt of the alkyl ethoxy carboxylate, most preferably after the composition has been neutralized with a strong base.

Although alkyl ethoxy carboxylate surfactant-containing compositions containing magnesium ions or having an alkaline pH, i.e. from about 8 to 10, each exhibit improved grease cleaning, such compositions having both characteristics, i.e. containing magnesium ions and having an alkaline pH, provide good grease cleaning, but exhibit poor storage stability due to $Mg(OH)_2$ precipitate formation.

In other words, it is known that a source of magnesium ions in alkaline detergent compositions containing alkyl ethoxy carboxylate surfactants provide good grease cleaning. But the incompatability of magnesium ions in an alkaline environment prevents the incorporation of a significant amount of thereof in the compositions.

It has now been discovered that the incorporation of a magnesium chelating agent (described below) into the compositions herein prevents the formation of $Mg(OH)_2$ precipitates and makes it possible to incorporate larger doses of magnesium ions, at higher pH levels, required in soft water areas where the divalent ion concentration is low.

Therefore, the level of magnesium ions in the composition is from about 0.1% to 3%, preferably from about 0.3% to 2%, most preferably from about 0.5% to 1%, by weight.

In addition, the amount of magnesium ions present in compositions of the invention will be dependent upon the amount of total anionic surfactant present therein, including the amount of alkyl ethoxy carboxylates. When magnesium ions are present in the compositions of this invention, the molar ratio of magnesium ions to total anionic surfactant is from about 0.25:1 to about 1:1 for compositions of the invention.

Magnesium Chelating Agent

The composition of the invention hereof contains a magnesium chelating agent to sequester magnesium ions present in the liquid phase of the composition thereby inhibiting the interaction between the magnesium and hydroxide ions which would result in the formation of $Mg(OH)_2$ precipitates.

The magnesium complex the chelating agent forms must be soluble. If an insoluble magnesium-chelant complex is formed, it will cause unsightly product turbidity, and if the complex settles to the bottom of the product there may be insufficient levels of magnesium ion delivered to the wash solution upon normal dispensing of the product.

The chelating agent must associate with the magnesium ions only moderately, i.e. only strong enough to prevent interaction between the magnesium and hydroxide ions, but not too much so as to significantly reduce the amount of magnesium ions available in dilute solution. Therefore, the formation constant, log $K_f$, for the chelating agent is between about 0.5 and 5.

The amount of chelating agent present in the composition of the invention hereof is that amount sufficient to prevent the formation of $Mg(OH)_2$ precipitates in the composition. This amount is dependent upon three factors: the desired pH of the composition in dilute solution, the strength of the chelating agent, i.e. its log $K_f$, and the desired level of magnesium ions in the composition.

Higher desired pH levels of a composition in dilute solution results higher concentrations of hydroxide ions in the composition. This in turn results in more hydroxide ions in the composition available to interact with magnesium ions in the composition and a higher tendency to form $Mg(OH)_2$ precipitates therein. This requires a higher level of a chelating agent incorporated into the composition provided the same chelating agent is used. The use of a stronger chelating, i.e. higher log $K_f$ could replace the use of more of a weaker chelating agent.

More importantly, the log of formation constant, log $K_f$, must be considered in determining the amount of chelating agent to use in a composition. The log $K_f$ of the chelating agent is between about 0.5 and 5, preferably between 1 and 3.5. The higher the log $K_f$, the tighter the hold on magnesium ions, and the less required for the prevention of $Mg(OH)_2$ precipitate formation in the composition. The amount of chelating agent in the compositions hereof is set forth in Table I, below. In determining the amount of chelating agent to use in compositions of the invention hereof, the formulator must determine the log $K_f$ of the chelating agent. A method for determining the formation constants of these chelating agents is described in *Determination and Use of Stability Constants*; A. E. Martell and K. J. Motekaitis; V. C. Publishers Inc. (1988, N.Y., N.Y.) incorporated herein by reference. *Critical Stability Constants*; R. M. Smith and A. E. Martell; Plenum Publishers (1974–81, N.Y., N.Y.) lists formation constants for various common inorganic compounds, incorporated herein by reference. Based upon the level of magnesium ions and the pH level desired for the composition, the formulator can determine a range for the amount of a chelating agent required in the composition.

TABLE I

| log $K_f$ | % (by weight) |
|---|---|
| 0.5 to 1.5 | <10 |
| 1.5 to 3 | <8 |
| 3 to 5 | <3 |

Examples of suitable chelating agents are sodium citrate, bicine (bis(2-ethanol)glycine), sarcosine (N-methylglycine), N-2-hydroxyethyl iminodiacetic acid (HIDA), N-(2,3-dihydroxypropyl)iminodiacetic acid (GIDA), N-(2-(2-hydroxyethoxy)ethyl) iminodiacetic acid {DIDA), and their alkali metal salts. Mixtures of the above are acceptable.

Preferred chelating agents are sodium citrate and bicine. The most preferred chelating agent is bicine. Primary amines, e.g. glycine, are not preferred as chelating agents for compositions of the invention hereof because they tend to cause discoloration of the composition upon storage. Therefore, preferred compositions of the invention hereof are substantially free of chelating agents that are primary amines.

Particular chelating agents and alkalinity buffering agents work well together in compositions of the invention hereof. These include: citrate with alkanol amines (including 2-amino-2-ethyl-1,3-propanediol, 2-amino-2-methyl-1,3-propanediol, and 2-amino-2-methylpropanol); bicine with tris; bicine with N-methyldiethanolamine; bicine with diethanolamine; bicine with 1,3-diamino-2-propanol; and bicine with triethanolamine. Those combinations containing bicine are most preferred.

Co-Surfactants

The compositions of this invention preferably contain certain co-surfactants to aid in the foaming, detergency, and/or mildness.

Included in this category are several anionic surfactants commonly used in liquid or gel dishwashing detergents. The cations associated with these anionic surfactants can be the same as the cations described previously for the alkyl ethoxy carboxylates. Examples of anionic co-surfactants that are useful in the present invention are the following classes:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $RO\text{-}SO_3^-M^+$ where R is the $C_{8-22}$ alkyl group and M is a mono- and/or divalant cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3^-M^+$$

where R is the $C_{8-22}$ alkyl group, x is 1–30, and M is a mono- or divalent cation.

(6) Alkyl glyceryl ether sulfonates having 8 to 22 carbon atoms, preferably 12 to 16 carbon atoms, in the alkyl moiety.

(7) Dialkyl sulfosuccinates of the formula:

$$\begin{array}{l} CH_2 — CH — SO_3^-M^+ \\ | \qquad\quad | \\ COOR_1 \quad COOR_2 \end{array}$$

where each of $R_1$ and $R_2$, which may be the same or different, represents a straight chain or branched chain alkyl group having from about 4 to 10 carbon atoms and more preferably from about 6 to 8 carbon atoms, and $M^+$ represents a mono-or divalent cation. A more complete description of suitable dialkyl sulfosuccinates can be found in GB 2,105,325 and GB 2,104,913.

(8) Fatty acid ester sulfonates of the formula:

$$R_1-CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono- or divalent cation.

(9) Mixtures Thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful co-surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

The compositions hereof may also contain a polyhydroxy fatty acid amide surfactant of the structural formula:

$$\begin{array}{l} \quad\;\; O \quad R^1 \\ \quad\;\; \| \quad\;\; | \\ R^2-C-N-Z \end{array} \qquad (I)$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cycic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In a preferred process for producing N-alkyl or N-hydroxyalkyl, N-deoxyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxy-propyl, the product is made by reacting N-alkyl - or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate.

These polyhydroxy "fatty acid" amide materials also offer the advantages to the detergent formulator that they can be prepared wholly or primarily from natural, renewable, non-petrochemical feedstocks and are degradable. They also exhibit low toxicity to aquatic life.

It should be recognized that along with the polyhydroxy fatty acid amides of Formula (I), the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amide-containing composition added to the detergent contains less than about 10%, preferably less than about 4%, of cyclic polyhydroxy fatty acid amide. The preferred processes described above are advantageous in that they can yield rather low levels of by-products, including such cyclic amide by-product.

The co-surfactants for the compositions of this invention can also contain mixtures of anionic surfactants with alkyl polyglucosides or polyhdroxy fatty acid amides. The co-surfactants are present in the composition at a level of from 0% to about 35% by weight, preferably from about 5% to 25%, and most preferably from about 7% to 20%.

Suds Booster

Another component which may be included in the composition of this invention is a suds stabilizing surfactant (suds booster) at a level of less than about 15%, preferably from about 0.5% to 12%, more preferably from about 1% to 10%. Optional suds stabilizing surfactants operable in the instant composition are of five basic types—betaines, ethylene oxide condensates, fatty acid amides, amine oxide semi-polar nonionics, and cationic surfactants.

The composition of this invention can contain betaine detergent surfactants having the general formula:

$$R-\overset{(+)}{N}(R^1)_2-R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethyl ammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanol amides of fatty acids having an acyl moiety containing from about 8 to about 18 carbon atoms and represented by the general formula:

$$R_1—CO—N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula

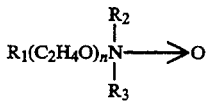

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

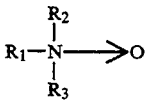

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The composition of this invention can also contain certain cationic quarternary ammonium surfactants of the formula:

$$[R^1(OR^2)_y][R^3(OR^2)_y]_2R^4N^+X^-$$

amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl)-methylammonium salts, the $C_{8-16}$ alkyl hydroxyethyl-dimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethyl ammonium salts .are preferred, e.g., decyl trimethyl ammonium methylsulfate, lauryl trimethylammonium chloride, myristyl trimethyl ammonium bromide and coconut trimethyl ammonium chloride, and methylsulfate.

The suds boosters used in the compositions of this invention can contain any one or mixture of the suds boosters listed above.

Additional Optional Ingredients

In addition to the ingredients described hereinbefore, the compositions can contain other conventional ingredients suitable for use in liquid or gel dishwashing compositions.

Optional ingredients include drainage promoting ethoxylated nonionic surfactants of the type disclosed in U.S. Pat. No. 4,316,824, Pancheri (Feb. 23, 1982), incorporated herein by reference.

Alcohols, such as ethyl alcohol and propylene glycol, and hydrotropes, such as sodium and potassium toluene sulfonate, sodium and potassium xylene sulfonate, trisodium sulfosuccinate, and related compounds (as disclosed in U.S. Pat. No. 3,915,903, incorporated herein by reference), and urea, can be utilized in the interests of achieving a desired product phase stability and viscosity. Alcohols such as ethyl alcohol and propylene glycol at a level of from 0% to about 15%, potassium or sodium toluene, xylene, or cumene sulfonate at a level of from 0% to about 10%, urea at a level of from 0% to about 10%, and trisodium sulfosuccinate at a level of from 0% to about 15% are particularly useful in the liquid compositions of the invention.

Gel compositions of the invention normally would not contain alcohols. These gel compositions may contain higher levels of potassium or sodium toluene, xylene, or cumene sulfonate, and urea at higher levels, i.e., from about 10% to about 30%, as gelling agents (see U.S. Pat. No. 4,615,819 and GB 2,179,054A).

Other desirable ingredients include diluents and solvents. Diluents can be inorganic salts, such as sodium sulfate, ammonium chloride, sodium chloride, sodium bicarbonate, etc., and the solvents include water, lower molecular weight alcohols, such as ethyl alcohol, isopropyl alcohol, etc. Compositions herein will typically contain up to about 80%, preferably from about 30% to about 70%, most preferably from about 40% to about 65%, of water.

As used herein, all percentages, parts, and ratios are by weight unless otherwise stated.

The following Examples illustrate the invention and facilitate its understanding.

EXAMPLE I

The following four liquid compositions of the present invention are prepared according to the description set forth below.

The formulations are made by adding ethanol to the alkyl ethoxy carboxylate-containing surfactant mixture. The remaining surfactants are then added and mixed in.

The buffering and chelating agents are then added and the pH is adjusted to about 0.5 pH units above the target for the formula with sodium hydroxide. Finally, the magnesium chloride is added, which reduces the pH to the target. Final viscosity and minor pH adjustments can be made at this time, followed by the addition of perfume and dye. The balance is water.

| Components | % By Weight | | | |
|---|---|---|---|---|
| | Formulation A | Formulation B | Formulation C | Formulation D |
| Sodium $C_{12-13}$ alkyl ethoxy (3.5 ave.) carboxylate* | 22 | 22 | 24 | 12 |
| $C_{12-13}$ alkyl ethoxy (3.5 ave.) alcohol* | 1.3 | 1.3 | 1.4 | 0.7 |
| Sodium $C_{12-13}$ alkyl sulfate | 6 | 6 | 3 | — |
| Sodium $C_{12-13}$ alkyl ethoxy (0.8 ave.) sulfate | — | — | — | 18 |
| $C_{12-14}$ alkyl amidopropyl dimethyl betaine | 3 | 3 | 3.5 | 2.5 |
| $C_{12-14-16}$ alkyl dimethyl amine oxide | 3 | 3 | 3.5 | — |
| $C_{9-10-11}$ alkyl ethoxy (ave. 8) alcohol | — | — | — | 2.5 |
| Magnesium ions (added as $MgCl_2.6H_2O$) | 0.6 | 0.6 | 0.9 | 0.6 |
| Methyldiethanol amine | 10 | — | — | — |
| Diethanol amine | — | 5 | — | — |
| Triethanol amine | — | — | 2.5 | — |
| Glycine | — | — | — | 5 |
| Tris(hydroxymethyl) aminomethane | — | — | — | 5 |
| Trisodium sulfosuccinate | — | — | 5 | — |
| Bicine | 5 | 5 | 2.5 | — |
| Ethanol | 9 | 9 | 9 | 1 |
| Perfume and dye | 0.15 | 0.15 | 0.15 | 0.15 |
| Water | Balance | | | |
| pH (0.2% aqueous solution) | 9.2 | 9.0 | 8.3 | 9.5 |

*The surfactant mixture contains about 94.2% alkyl ethoxy carboxylates of the formula $RO(CH_2CH_2O)_xCH_2COO^-Na^+$ where R is a $C_{12-13}$ alkyl averaging 12.5; x ranges from 0 to about 10, and the ethoxylate distribution is such that the amount of material where x is 0 is about 1.0 and the amount of material where x is greater than 7 is less than about 2% by weight of the alkyl ethoxy carboxylates. The average x in the distribution is 3.5. The surfactant mixture also contains about 5.8% of alcohol ethoxylates of the formula $RO(CH_2CH_2O)_xH$ with R being a $C_{12-13}$ alkyl averaging 12.5 and the average x: 3.5. The surfactant mixture contains 0% soap materials.

The above formulations give excellent combinations of grease cleaning and mildness and do not exhibit precipitation when stored at elevated temperatures (up to 120° F.). The grease cleaning ability of these products is directly related to their ability to maintain dilute solution alkaline wash pH. The rank order of these products in terms of their ability to maintain a high wash pH is A>B>C>D. The hand mildness of these products are directly related to their levels of alkyl ethoxy carboxylate-containing surfactant mixture and inversely related to their levels of alkyl sulfate and alkyl ethoxy sulfate surfactants. For these reasons the rank order of hand mildness of these products is C>A,B>D. These formulations also provide superior stability during storage especially when compared to similar compositions without a buffering and/or chelating agent. Formulation D, however, contains glycine and does exhibit discoloration of the composition upon storage.

EXAMPLE II

The following four liquid compositions are prepared according to the method set forth in Example I. They use the same alkyl ethoxy carboxylate surfactant mixture set forth in Example I.

| Components | % By Weight | | | |
|---|---|---|---|---|
| | Formulation A | Formulation B | Formulation C | Formulation D |
| Sodium $C_{12-13}$ alkyl ethoxy (3.5 ave.) carboxylate* | 22 | 22 | 22 | 22 |
| $C_{12-13}$ alkyl ethoxy (3.5 ave.) alcohol* | 1.35 | 1.35 | 1.35 | 1.35 |
| Sodium $C_{12-13}$ alkyl sulfate | 6 | 6 | 6 | 6 |
| $C_{12-14}$ alkyl amidopropyl dimethyl betaine | 3 | 3 | 3 | 3 |
| $C_{12-14-16}$ alkyl dimethyl amine oxide | 3 | 3 | 3 | 3 |
| Magnesium ions (added as $MgCl_2.6H_2O$) | 0.6 | 0.6 | 0.6 | |
| 2-Amino-2-ethyl-1,3-propanediol | 6 | 6 | 6 | 6 |
| Citric acid (exists as a citrate salt in the product) | — | 2.0 | 6.0 | — |
| Minors (solvents, hydrotropes, dye, perfume, etc) | Balance | | | |
| pH (0.2% aqueous solution) | 9.0 | 9.0 | 9.0 | 9.0 |

Formulation B of the present invention provides both good dilute solution grease cleaning and formulation storage stability at elevated temperatures of 120° F. This is in contrast to Formulations A, C and D which are not within the scope of the present invention. Formulation A provides good dilute solution grease cleaning, even in soft water, because of its combination of alkylethoxy carboxylate containing surfactant mixture, magnesium ions and its alkaline pH in a dishwashing solution due to 2-Amino-2-ethyl-1,3-propanediol. However, Formulation A is not stable to storage and precipitates of $Mg(OH)_2$ are formed. Formulation C provides good product storage stability by virtue of the citrates ability to prevent $Mg(OH)_2$ precipitation but does not provide sufficient grease cleaning ability in dilute solution. This is because the level of citrate is too high and reduces the available $Mg^{++}$ in dilute solution needed for good cleaning. Similarly, Formulation D provides good storage stability but poorer grease cleaning than Formulations A and B.

What we claim is:

1. A light-duty liquid or gel dishwashing detergent composition comprising, by weight:

(a) from about 5% to 70% of a surfactant mixture comprising, by weight:

(i) from about 70% to 100% of alkyl ethoxy carboxylates of the formula:

$$RO(CH_2CH_2O)_xCH_2COO^-M^+$$

wherein R is a $C_{12}$ to $C_{16}$ alkyl group, x ranges from 0 to about 10 and the ethoxylate distribution is such that, on a weight basis, the amount of material where x is 0 is less than about 20% and the amount of material where x is greater than 7 is less than about 25%, the average x is from about 2 to 4 when the average R is $C_{13}$ or less, and the average x is from about 3 to 6 when the average R is greater than $C_{13}$, and M is a cation;

(ii) from 0% to about 15% of alcohol ethoxylates of the formula:

$RO(CH_2CH_2O)_xH$ wherein R is a $C_{12}$ to $C_{16}$ alkyl group and x ranges from 0 to about 10 and the average x is less than about 6; and (iii) from 0% to about 15% of soaps of the formula:

$RCOO^-M^+$ wherein R is a $C_{11}$ to $C_{15}$ alkyl group and M is a cation;

(b) from about 0.1% to about 3% of magnesium ions;

(c) a magnesium chelating agent which forms a soluble magnesium complex, having a log of formation constant, log $K_f$, between about 1 and about 3.5; the agent being selected from the group consisting of sarcosine (N-methylglycine), bicine (bis(2-ethanol) glycine), N-2-hydroxyethyl iminodiacetic acid, N-(2,3-dihyroxypropyl) iminodiacetic acid, their alkali metal salts, and mixtures thereof, in an amount sufficient to prevent the formation of $Mg(OH)_2$ precipitates in the composition; and (d) sufficient alkalinity buffering agent selected from the group consisting of 2 amino-2-ethyl-1,3-propanediol, 2-amino-2-methyl propanol, 2-amino-2-methyl-1,3-propanediol, tris-(hydroxymethyl) aminoethane, disodium glutamate, N-methyl diethanolamine, 1,3-diamino-2-propanol, N,N'-tetramethyl-1,3-diamino-2-propanol, N tris (hydroxymethyl) methyl glycine and mixtures thereof to maintain the pH of the composition between about 8 and 10 when diluted with water to about 0.1% to 0.4%, by weight.

2. A liquid composition of claim 1 comprising from about 10% to 30% of the surfactant mixture.

3. The composition of claim 1 wherein the surfactant mixture comprises from about 80% to 95% alkyl ethoxy carboxylates, less than about 10% alcohol ethoxylates, and less than 10% soap.

4. The composition of claim 2 wherein the surfactant mixture comprises from about 80% to 95% alkyl ethoxy carboxylates, less than about 10% alcohol ethoxylates, and less than 10% soap.

5. The composition of claim 1 comprising from about 0.5% to 1% of magnesium ions.

6. The composition of claim 4 comprising from about 0.5% to 1% of magnesium ions.

7. The composition of claim 1 wherein the chelating agent is selected from the group consisting of bicine, its alkali metal salts, and mixtures thereof.

8. The composition of claim 5 wherein the chelating agent is selected from the group consisting of bicine, its alkali metal salts, and mixtures thereof.

9. The composition of claim 6 wherein the chelating agent is selected from the group consisting of bicine, its alkali metal salts, and mixtures thereof.

10. The composition of claim 1 wherein the pH is from about 8.5 to 9.5.

11. The composition of claim 1 wherein the buffering agent has a pKa from about 7 to 9.5.

12. The composition of claim 1 wherein the buffering agent is selected from the group consisting of N-methyl diethanolamine, 1,3-diamino-2-propanol, N,N'-tetramethyl-1,3-diamino-2-propanol.

13. The composition of claim 12 wherein the buffering agent is selected from the group consisting of N-methyl diethanolamine, 1,3-diamino-2-propanol, N,N'-tetramethyl-l,3-diamino-2-propanol.

14. The composition of claim 1 wherein the chelating agent is selected from the group consisting of bicine, its alkali metal salts, and mixtures thereof, and the buffering agent is an alkanol amine selected from the group consisting of tris, N-methyl diethanolamine, diethanolamime, 1,3-diamino-2-propanol, triethanolamine, and mixtures thereof.

15. The composition of claim 5 wherein the chelating agent is selected from the group consisting of bicine, glycine and mixtures thereof; and the buffering agent is an alkanol amine selected from the group consisting of tris, N-methyl diethanolamine, diethanolamime, 1,3-diamino-2-propanol, triethanolamine, and mixtures thereof.

16. The composition of claim 1 further comprising a co-surfactant selected from the group consisting of alkyl sulfates, alkyl ether sulfates, fatty acid ester sulfonates, alkyl polyglucosides, polyhydroxy fatty acid amides, and mixtures thereof.

17. The composition of claim 15 further comprising a co-surfactant selected from the group consisting of alkyl sulfates, alkyl ether sulfates, fatty acid ester sulfonates, alkyl polyglucosides, polyhydroxy fatty acid amides, and mixtures thereof.

18. The composition of claim 1 further comprising a suds booster selected from the group consisting of betaines, amine oxide semi-polar nonionics, fatty acid amides, and mixtures thereof.

19. The composition of claim 15 further comprising a suds booster selected from the group consisting of betaines, amine oxide semi-polar nonionics, fatty acid amides, and mixtures thereof.

20. A gel composition of claim I comprising from about 10% to 45% of the surfactant mixture.

* * * * *